United States Patent [19]

Luszczak

[11] 4,227,965

[45] Oct. 14, 1980

[54] PRODUCTION OF HARDBOARD

[75] Inventor: Myron M. Luszczak, Palatine, Ill.

[73] Assignee: United States Gypsum Company, Chicago, Ill.

[21] Appl. No.: 54,206

[22] Filed: Jul. 2, 1979

[51] Int. Cl.[2] ..... D21B 1/04

[52] U.S. Cl. ..... 162/13; 162/26; 162/75; 162/150; 162/179; 162/221; 162/225; 162/DIG. 2

[58] Field of Search ..... 162/13, 20, 25, 26, 162/27, 75, 142, 150, 179, 182, 183, 225, 221, 206, 207, DIG. 2

[56] References Cited

U.S. PATENT DOCUMENTS

| | | | |
|---|---|---|---|
| 2,044,213 | 6/1936 | Irvine | 162/179 |
| 2,388,487 | 11/1945 | Linzell | 162/225 |
| 2,495,043 | 1/1950 | Willey et al. | 162/225 |
| 3,130,114 | 4/1964 | Nagy et al. | 162/13 |

FOREIGN PATENT DOCUMENTS

| | | | |
|---|---|---|---|
| 549791 | 12/1957 | Canada | 162/13 |

*Primary Examiner*—S. Leon Bashore
*Assistant Examiner*—Peter Chin
*Attorney, Agent, or Firm*—Kenneth E. Roberts; Robert H. Robinson; Samuel Kurlandsky

[57] ABSTRACT

A process for improving the strengths and resistance to water absorption of wood fiber hardboard, along with a lessening in the number of conventional steps, is disclosed. Hardboad is thereby produced by a process wherein drying oil is added to the wood chips prior to the pulp preparation stage; and optionally an oxidation accelerator is added during the pulp preparation stage. The hardboard is then formed in the usual manner without requiring the conventional addition of binder ingredients in the stock chest, without requiring conventional baking following pressing and, in the case of "tempered" hardboard without requiring the subsequent addition of tempering materials and baking following the conventional press operation.

9 Claims, 1 Drawing Figure

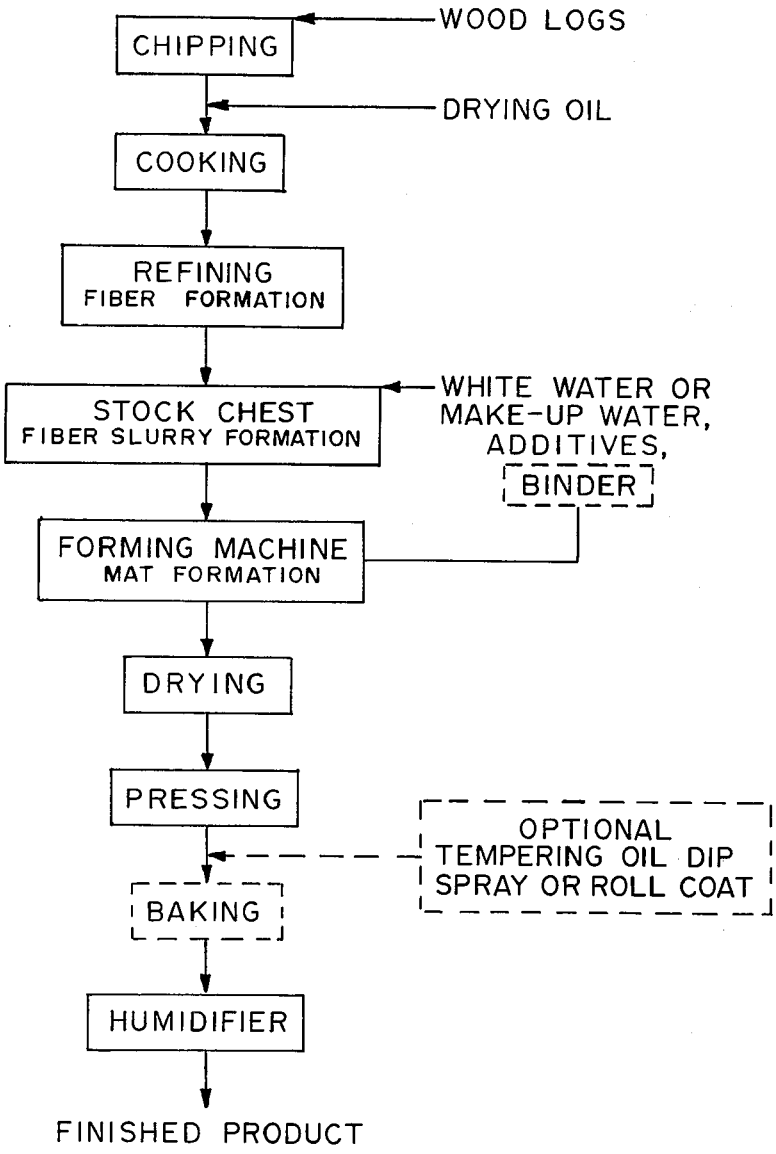
WOOD LOGS
CHIPPING
DRYING OIL
COOKING
REFINING
FIBER FORMATION
WHITE WATER OR
MAKE-UP WATER,
ADDITIVES,
BINDER
STOCK CHEST
FIBER SLURRY FORMATION
FORMING MACHINE
MAT FORMATION
DRYING
PRESSING
OPTIONAL
TEMPERING OIL DIP
SPRAY OR ROLL COAT
BAKING
HUMIDIFIER
FINISHED PRODUCT

PRODUCTION OF HARDBOARD

BACKGROUND OF THE INVENTION

1. Field of the Invention

This invention relates to the manufacture of compressed wood fiber products, particularly to panel products made from lignocellulosic fibers and commonly termed "hardboard". The invention is particularly concerned with the production of hardboard having some of those properties characteristic in the industry to "tempered" hardboard.

2. Description of the Prior Art

In order to better understand the prior art and the present invention, reference may be made to the accompanying drawing illustrating the schematic flow diagrams of the processes.

In general, the making of hardboard involves reducing wood logs or billets to chips. The chips are subjected to a cooking treatment with steam to soften them, then reduced to fibers by a mechanical refining process in an attrition device such as a disc refiner followed by further mechanical refining in a beater, Jordan refiner or the like. Alternatively, increasingly high steam pressures up to about 1,200 p.s.i. may be used on the chips, followed by a quick depressurization to disintegrate the chips into fibers and fibrille fractions. The prior art has then provided a couple of different basic processes for felting the fiber into hardboard, the wet process and the dry process. In the wet felting processes, the fibers are formed into an aqueous slurry of suitable consistency which is chemically treated as with binding oils or resins, sizes, pH adjusting chemicals and the like in a stock chest and the slurry is passed to the drainage wire of a forming machine in order to produce a wet mat by drainage of the aqueous suspension and partial further dewatering by cold roller pressing. The mat may then be wet pressed or dry pressed, but generally the cold pressed wet mat is pressed against a wire screen (as against a patterned top caul plate where a surface embossing is desired) and further partially dried in the case of smooth on both sides (S-2-S) product; where upon the mat goes into hot air dryers to reduce the moisture content to a low value (e.g. less than 1%). The dried mat is then hot pressed at high temperature, e.g., 400°-600° F. and high pressure, e.g., about 500-1,000 p.s.i. at short cycle times; oven baked and rehumidified in humidifying chambers, and then constitutes the final product for industrial uses or optionally it may be further fabricated and decoratively finished, e.g., as by various coatings and cutting on the surface for a decorative patterned hardboard.

Dry fiber felted hardboard follows the same general process sequence as above except the fiber furnish is dried after preparation from the wood chips and before chemical treatment and mat formation. Fiber handling and mat forming techniques, of course, differ from wet process methods in that the fiber is handled in air and not in water. The present invention is concerned with a wet forming and dry pressing form of process referred to above, and provides for the production of high quality hardboard in a wet felting process. The resulting hardboard by the above processes, while possessing many excellent properties, has in the past suffered from low strengths and high moisture take-up. These hardboards will absorb water which reduces the strength of the board and frequently causes appreciable dimensional changes in the board. The attendant swelling and shrinkage causes destruction of the boards at their edges, reduces racking strength and may result in usage disformation. In the past these problems have generally been handled by "tempering-baking" the finally produced standard hardboard. Historically, oil tempered boards have been manufactured by dipping the pressed hardboard in a large tank of drying oil, leaving the hardboard for a short interval of time in the oil to permit absorption, and thereafter baking the oil soaked board in an oven at a temperature within the range of about 300°-450° F. for about 1-6 hours in order to set or stabilize the oil to a resin-like material. Alternatively the oil may be added by roller coating or spraying instead of dipping in these conventional manners of manufacture, an additional 1% to 3% by dry weight of the board of a drying oil is absorbed and then oxidized by the lengthy high temperature baking. This requires considerable monetary outlay for the installation and maintenance of additional equipment, and frequently the tempering oil does not become uniformly distributed throughout the board or uniformly distributed from one board to another.

One prior art process, generally to show the state of the art for producing regular hardboard by the wet process, is shown in U.S. Pat. No. 4,009,073 for a closed water system to produce an increased concentration of sugars on the mat surface, and employs conventional oven drying followed by pressing preferably at higher than ordinary temperatures, e.g., from 450° to about 500° F.; and in the case of "tempered" hardboard the additional steps of further adding 2 to 10 lbs. per thousand square feet of surface area of an oxidizable resin or oil. The treated board is then heat treated in an oven for 2½ to 4 hours at 280° F. to assist in curing the tempering oil. This patent states that this baking treatment for tempering will also improve physical properties of non-tempered board as well.

Further, U.S. Pat. No. 2,978,382 proposes an alternative tempering process in which the additional drying oil is suspended in a water slurry and applied to the wet mat after partial dewatering. The mat is subsequently subjected to the conventional hot pressing operation and to the conventional baking operation to set the drying oil to a resin-like material. U.S. Pat. No. 3,056,718 proposes a further variation using a non-conjugated drying oil after partially dewatering the mat and before drying of the board. This is done to eliminate the wire screen marks in the production of S-2-S hardboard. In this instance a spray of oil is directed onto the wet mat which then again travels into a dryer for drying with hot air at a temperature of about 300° F. to about 750° F. and is finally consolidated by heated hydraulic press operation at about 1,000 p.s.i. pressure and a temperature of 240° C. (464° F.).

Also, although only remotely related, the following patents should be mentioned. U.S. Pat. No. 2,721,504 during mat formation and before final pressing suggests the addition of a drying oil which will then partially cure during pressing for an improvement in an S-1-S hardboard; U.S. Pat. No. 153,749 mentions the addition of linseed oil soaking for a roofing paper to impart weather resistance to that paper; U.S. Pat. No. 2,423,214 discloses the treatment of paper-making furnish by the addition of a linseed oil aqueous emulsion added to the stock chest in the manufacture of ground wood printing paper; and U.S. Pat. No. 3,455,779 discloses the addition of alum to a wood fiber slurry prior to mat formation followed by the addition of an alkali metal salt of tall oil to the treated slurry in order to improve water absorption dimensional changes of the resultant hardboard.

SUMMARY OF THE INVENTION

A key feature of the present invention is that drying oil is impregnated into the wood chips prior to the pulp preparation stage and appears to be intimately absorbed with the wood before defibrulation and stays with the resultant fibers throughout the rest of the normal hardboard process. It has been found surprisingly, that oil saturating the wood chips is not detrimental to hardboard qualities but, in fact, serves to significantly improve the board characteristics as will be more fully described hereafter.

Thus, in one aspect, the present invention provides a process of manufacturing hardboard including the steps of: reducing wood to chips; mixing at least a portion of the chips with a drying oil; sorbing the drying oil into the chips during cooking of the chips; subjecting the treated chips to an aqueous digestion so as to form fibers from the treated chips; forming the fibers into an aqueous pulp stock slurry comprising a dilute suspension of fiber in water; mechanically dewatering the pulp to obtain a wet mat; drying the wet mat by thermal evaporation; and pressing the dry mat between heated forming surfaces to form a hardboard, said process characterized in that the normal baking step following hardboard pressing may be eliminated.

Thus, an object and advantage is to provide a process for the production of hardboard which eliminates the need for a baking step following pressing of the mat to hardboard.

A further object and feature of the invention is to obtain hardboard products having at least some of the characteristics of "tempered" hardboard without requiring the addition step to regular hardboard manufacturing procedures of subsequent treatment with an oil or resin followed by baking.

Another feature of the invention is the elimination of a binder as such and the attendant emulsification steps on ordinary binder addition to the head box of the mat forming step.

Still another feature of the invention is to provide an improved hardboard product having enhanced water and weather resistance features and which at the same time possesses increased strengths and reduced linear expansion on water takeup without such product having gone through the customary "tempering" steps in hardboard manufacture.

BRIEF DESCRIPTION OF THE DRAWINGS

A typical process according the invention will be now described with reference to the FIGURE which illustrates in schematic form a process according to the present invention in solid lines, with conventional steps and materials eliminated by the process in dotted lines.

DETAILED DESCRIPTION OF THE PREFERRED EMBODIMENTS

Referring generally to the FIGURE, wood chips obtained in the wood yard have a drying oil of the invention blended with them as they travel to a digester where the chips are cooked and softened for fiberization and then travel to a refiner where the cooked wood chips are fiberized. From there the fibers pass into the stock chest for formation into a dilute aqueous suspension along with some of the conventional additives to provide the feed for a conventional hardboard forming machine which forms a wet mat. The wet mat passes into hot air dryers for removal of moisture; and is then hot pressed. Thereafter conventionally the pressed mat would be baked to complete the curing of the board. The board may then be humidified and then fabricated and finished as desired. In contrast to the most common tempered hardboard process, the ensuing oil bath and baking are eliminated. In the process of the present invention, in the digesting step, as effected in the so called "rapid cycle" digester, wood chips are steamed in a closed vessel for about 1 to 10 minutes at pressures varying from about 50 to 300 lbs. per square inch depending on wood species, fiber quality desired, etc. No free water is usually present in the rapid cycle system since the moisture content of the cooked chips is approximately the same as the raw wood; and in operations conventional heretofore generally speaking no chemicals would be added to assist in wood cooking. However, in the present process at least a portion of the chips before entering the cookers are treated with a drying oil.

Any of the drying oils commercially used in the manufacture of tempered hardboards may be utilized in this process. Drying oils are a known class of chemicals which includes, for example, chisia oil, fish oil, hempseed oil, linseed oil, oiticica oil, perilla oil, poppyseed oil, safflower oil, soybean oil, sunflower oil, tung oil, and walnut oil. In the preferred forms of these drying oils, a major portion of the saturated fatty acids are removed therefrom leaving a more reactive form of the particular drying oil used. Further, more preferably the specific preferred drying oils used in the invention may be a combination of two or more drying oils, and may also preferably be modified by being partially oxidized or subjected to a "boiling" treatment or both such as with the commonly available "boiled" linseed oil which further may have oxidization catalysts added thereto. Such are called "driers" in the trade and commonly include salts of metals with a valence of two or greater (such as cobalt, manganese, cerium, lead, chromium, iron, nickel, uranium and zinc) and often further include unsaturated organic acids. Frequently these are prepared as the linoleates, naphthenates and resinates of the above listed metals. In addition, it may be advantageous to add an oxidation accelerator to the pulp at the head box to speed the reactivity of the oil in order to insure that the oil cures in the pressing step.

Further, it has been found that not all of the wood chips to be used in making the hardboard need to be treated. There is for example substantial improvement when only about 30% by weight of the total chips to be added to the refiner are oil treated; though such improvement is not as good as when all chips have been treated.

The amount of the oil incorporated in the wood chips may be varied considerably, depending principally upon the characteristics that are desired in the finished hardboard. The greater the amount of oil soaked into the chips prior to refining and the greater the proportion of oil-soaked chips to untreated chips that is present for fiberizing, the greater the improvement in strengths and water resistance of the hardboard. It has been found that providing about 1% to 5% based on the dry weight of the wood chips results in hardboard made without a baking step equivalent in properties to regular hardboard; and the addition of about 1% to 5% by weight based on the dry weight of the chips results in properties equivalent to a tempered hardboard without a baking step or the conventional oil treatment after pressing. The amount of oil to be added will be generally in the range of about 0.5% to 10% based on the dry weight of the wood chips. Somewhat more or less may be used but without apparent further substantial benefits. Increased water resistance and strengths is obtained in this range, although at the higher levels the resulting hardboard may have a density higher than that normally desired. On the other hand, use of substantially less than about 0.5% of the oil may make it necessary to bake the pressed product or to follow it with a conventional tempering treatment in order to obtain the level of board quality properties customarily required in the trade at the present.

The treated chips are subsequently fiberized in conventional atmospheric refining equipment. The refining step is entirely conventional in nature and need not be described in detail. For illustration the chips may be fed to a Bauer Refiner where the wood is force fed to the center of oppositely rotating discs, in the presence of some carrier water, and ground to a fiberous state having a TAPPI freeness level usually in the range of 10 to 50 seconds. The refined feed stock is then fed to the stock chest, the latter supplying the head box of the forming machine wherein a fibrous water suspension is formed. A typical feed pulp consistency is approximately 1–2% fiber solids in water, along with samll amounts of ferric sulfate at a rate of about 0.1–1% based on dry fiber weight. At this stage in the stock chest, it is normal in conventional processes to add approximately 1% of oxidizable oil binder such as linseed oil or thermosetting resin binder, and supplemental sizing agents such as emulsified or dispersed crude wax or rosin. However, it has been found in the present invention that such binder ingredients are not necessary when using the preferred amounts of oil treated chips.

Conventionally the foregoing dilute fiber solids slurry is mechanically dewatered, generally to about 40–45% solids in a two-stage operation prior to drying on a forming machine such as a typical Fourdrinier or Oliver forming machine, which are not important to this invention.

The partially dewatered mat is then fed to a gas, steam heated, or combination thereof, dryer where the mat is dewatered by means of thermal evaporization to about 90% to 98% solids content. Dryer temperatures generally range from about 275° F. to 550° F. and vary throughout the dryer to maximize drying rate; and drying time is about 1 to 2 hours in normal dryer operating conditions. Frequently this is followed with a second drying to remove the small amount of water left from the first stage in order that the bone dry mat can be now hot pressed without incurring delamination due to trapped water vapor. Dryer temperature in this second stage is generally about 300° F. and the time is about 1–2 hours. Optionally at this time a number of coatings or techniques well known to those skilled in the art to provide press release for sticky mats, particularly in S-2-S production, may be employed.

At this point conventional hardboard operations may provide various thermosetting/or oxidizable resins or oils to further improve the physical and surface finishing properties of the hardboard. The treated board would normally then be heat treated in ovens for at least 2 to 4 hours at 280° F.–300° F. to assist in curing the tempering oils added at this stage, as well as the previously added oil or other thermosetting binders. As indicated heretofore, this step is entirely unnecessary in the preferred embodiments of the present invention.

The pressing procedure is generally the same as that typically used in conventional operations, i.e., with press temperatures preferably about 400° F. to 500° F. with the press being operated at a pressure between about 100 to 2,000 lbs. per square inch applied to the mat, with the total press cycle time being selected in accordance with the desired temperatures and pressures. This is well known to those skilled in the art.

At this point, the board is bond dry and generally, for most uses, must be moistured or humidified to prevent buckling or warping in subsequent finishing or field installation operations. Such is normally accomplished by subjecting the board to very hot, humid air conditions as in a chamber approaching 40–95% relative humidity and 70°–200° F. for 2–48 hours duration. Thereby, the board absorbs from 2–9% moisture bu weight of the board and optionally may be passed to conventional finishing operations, such as to form interior decorative wall panels.

The following examples illustrate several embodiments of the invention. Such are intended as illustrative and are not to be construed as limiting the invention thereto. All parts are by weight unless otherwise stated. The physical properties reported in the examples were determined in accordance with the applicable test methods in Part B of American Society for Testing and Materials (ASTM) B 1037. For ease of reporting in the ensuing tables, certain of the test measurements are set forth in abbreviated form. Thus, "MOR" means modulus of rupture; "PERP. TENS." means tensile strength perpendicular to the surface; and "WATER ABS." means percent water absorption based on weight. Further, for ease of comparison between samples in the same series of evaluations but having different densities, certain of the property values reported in the tables have been corrected to a uniform density, which is footnoted in the ensuing tables.

Also for reference and comparison to the ensuing examples, reference may be had to the following characteristics derived from "Voluntary Products Standard PS 58–78 Basic Hardboard" approved by the American National Standards Institute on Dec. 18, 1973, as American National Standard A135.4-1973:

| Standard Hardboard, ⅛th inch nominal thickness | |
|---|---|
| Modulus of rupture | 5000 p.s.i. |
| Perp. Tens. | 100 p.s.i. |
| Water Absorption | 25% |
| Thickness swelling | 18% |
| Standard Hardboard, ¼th inch nominal thickness | |
| Modulus of rupture | 5000 p.s.i. |
| Perp. Tens. | 100 p.s.i. |
| Water Absorption | 20% |
| Thickness swelling | 14% |
| Tempered Hardboard, ⅛th nominal thickness | |
| Modulus of rupture | 7000 p.s.i. |
| Perp. Tens. | 150 p.s.i. |
| Water Absorption | 20% |
| Thickness swelling | 16% |

EXAMPLE 1

In this evaluation, three batches of mixed hardboard chips (mostly oak) were processed into nominal ⅛th inch hardboard, with two of the batches being treated with oil (5% and 10% respectively by weight based on the oven dried weight of the wood chips) and the remaining batch serving as a control. The control batch was conventionally processed with 1% of regular binder and 0.5% ferric sulfate processing aid being added at the stock chest. As further control comparison, a portion of the control batch was conventionally oven baked at 280°-300° F. for 2-4 hours following pressing while the remaining portion was not oven baked.

For the oil treatment, a drying oil was spray applied at a metered rate to a layer of chips which were then vigorously tumbled in order to distribute the oil uniformly and the chips passed to a cooking digester. The treated chips were allowed to steam cook at 100 p.s.i. for 2 minutes then passed to a Bauer refiner where they were refined at a 10% consistency to fiber pulp. A good quality pulp was made without shives or unrefined chop particles evident, and made up to a TAPPI freeness ranging from 14 to 16 seconds. The pulp was then dewatered and formed into mats; a portion of the mats being set aisde for physical properties testing and the remainder pressed at 1,800 p.s.i. for 75 seconds at 485° F. The pressing operation was normal for production of the nominal ⅛th inch hardboard, with no sticking or mat clinging to the press platens evident for any of the materials in this series. Some of the samples were then baked at 300° F. for 2 hours; then all of the hardboard produced was conditioned in a 70° F. and 50% relative humidity chamber for approximately 40 hours before determining physical properties. Physical properties of the mat and resultant hardobard are set forth in Table 1.

TABLE 1

| Additives: | Control[a] | 5% oil[b] | 10% oil[b] |
|---|---|---|---|
| Mat Properties | | | |
| Density, lbs./ft.$^3$ | 16.2 | 16.3 | 16.4 |
| M.O.R., p.s.i.[d] | 125 | 119 | 151 |
| Tensile, p.s.i.[d] | 100 | 97 | 120 |
| Hardboard Properties | | | |
| Density, lbs./ft.$^3$ | 68 | 69.8 | 70.4 |
| M.O.R., p.s.i.[e] | 6358 (4656)[c] | 8159 | 8421 |
| Perp. Tensile, p.s.i.[f] | 221 (155)[c] | 509 | 688 |
| Water Absorption, % | 24 (72)[c] | 18.8 | 23.4 |
| Thickness Swelling, % | 34 | 29.6 | 20.8 |

[a]Conventionally processed with 1% binder and 0.5% ferric sulfate added to stock chest and oven baked at 280°-300° F. for 2-4 hours.
[b]No binder but 0.5% ferric sulfate added to stock chest, unbaked.
[c]Values in parenthesis obtained on control sample that was not oven baked, for comparison.
[d]Corrected to 16 lbs./ft.$^3$ density for ease of comparison.
[e]Corrected to 70 lbs./ft.$^3$ density.
[f]Corrected to 65 lbs./ft.$^3$ density for ease of comparison.
[g]Corrected to 67 lbs./ft.$^3$ density.

Looking at Table 1, the series of mats showed negligible differences between oil treated chip mats versus the control mats. Looking at hardboard properties, the control samples conventionally processed with binder added to the stock chest and oven baked following pressing met the voluntary products standards PS58-73 on modulus of rupture and water absorption, but not thickness swelling; and the control conventionally processed without oven baking did not meet standards on any one of modulus of rupture, tensile strength perpendicular to surface, water absorption or thickness swelling. In contrast, hardboard made from the oil treated chips without baking following pressing not only met the voluntary standards for regular hardboard but also met the modulus of rupture requirements for tempered hardboard; for exceeded the tensile strength perpendicular to surface by a factor of about 5; and exhibited over 200% increase in perpendicular tensile over the conventionally produced board.

EXAMPLE 2

In this case, for further comparison, the drying oil was added after cooking but before refining the chips into fibers using the procedure set forth in the evaluations hereinabove. The test data, in Table 2, shows significant improvement in properties, however severe mat sticking and clinging to the press platens was encountered uing the pressing operation to form hardboard. At this time, it is believed that adding the drying oil after cooking causes the oil to stay more on the fiber surface and not penetrate into the fiber structure as well as when it is present during cooking.

TABLE 2

| Additives: | Control[a] | 3% Oil[b] Added after Cooking | Added Before Cooking |
|---|---|---|---|
| Hardboard Properties | | | |
| Density, lbs./ft.$^3$ | 64.3 | 68.3 | 66.9 |
| Transverse Breaking Strength, lbs. | 38.6 | 44.3 | 42.8 |
| M.O.R., p.s.i. | 5930 | 7354 | 7393 |
| Perp. Tens., p.s.i.[c] | 233 | 690 | 648 |
| Water Abs., % | 25.8 | 18.2 | 20 |
| Thickness Swelling, % | 29 | 19.9 | 21.2 |

[a]Regular binder and ferric sulfate added at stock chest; unbaked
[b]Ferric sulfate added at stock chest; unbaked
[c]Corrected to 65 lbs./ft$^3$ density.

EXAMPLE 3

In this case amounts of from 1-5% of raw linseed oil were applied to the wood chips using the procedures set forth in the evaluation hereinabove to produce nominal ⅛th inch hardboard. Results are set forth in Table 3, from which it may be seen that the wet mat strengths show no detrimental effects when the chips were treated with oil. With regard to the hardboard properties, oil treating the chips with amounts from 1% through 5% greatly improved properties in comparison to the oven baked control and generally exceptionally exceeded properties of the unbaked control, particularly with regard to strengths of the boards.

TABLE 3

| Additives: | Control[a] | 1% Oil | 2% Oil | 3% Oil | 4% Oil | 5% Oil |
|---|---|---|---|---|---|---|
| Hardboard Properties | | | | | | |
| Density, lbs./ft.$^3$ | 67.6 (63.9)[b] | 67.9 | 68.6 | 69.4 | 68.3 | 69.4 |
| M.O.R.,[c] p.s.i. | 7562 | 7368 | 772 | 8389 | 8585 | 8163 |
| Perp. Tensile,[d] p.s.i. | 383 (287) | 645 | 614 | 801 | 757 | 823 |
| Water Absorption, %[e] | 20.6 (28.2) | 20.9 | 22.4 | 25.2 | 23.2 | 22.3 |
| Thickness | | | | | | |

TABLE 3-continued

| Additives: | Control[a] | 1% Oil | 2% Oil | 3% Oil | 4% Oil | 5% Oil |
|---|---|---|---|---|---|---|
| Swelling, % | 28.9 | 25.7 | 26.4 | 26.8 | 23.8 | 23.3 |

[a]Conventionally processed with regular binder and accelerating agent added to stock chest and oven baked at 300° F. for 2 hours.
[b]Ibid but, for comparison not oven baked.
[c]Corrected to 67.5 lbs./ft.$^3$ density.
[d]Corrected to 69 lbs./ft.$^3$ density.
[e]Corrected to 66 lbs./ft.$^3$ density.

EXAMPLE 4

In this case nominal ¼ inch hardboard was made with 1–5% oil addition to the wood chips using the procedure hereinabove, with raw linseed oil being used as the drying oil and pressing for 120 seconds in a 485° F. heated platen press.

Mat formation and pressing operation were normal with no indication that oil treatment was in any way detrimental to wet mat formation and with no indication of mat sticking or other processing problems evident in the pressing operation. In this evaluation the hardboard samples were conditioned at 70° F. and 50% relative humidity in a closed chamber for 48 hours before determining physical properties as set forth in Table 4.

Looking at Table 4 generally, treating the wood chips with 1% of raw linseed oil and without baking the pressed board was almost equivalent in physical properties to the baked control sample; and the general overall trend of physical properties increased linearly on the addition of 1–5% of oil to the raw wood chips, particularly in comprison to the unbaked control sample.

TABLE 4

| Additives: | Control[a] | 1% Oil | 2% Oil | 3% Oil | 4% Oil | 5% Oil |
|---|---|---|---|---|---|---|
| Mat Properties | | | | | | |
| Density, lbs./ft.$^3$ | 14.3 | 16.0 | 14.9 | 15.0 | 14.8 | 15.3 |
| M.O.R.,[c] p.s.i. | 72 | 132 | 142 | 138 | 143 | 158 |
| Tensile,[d] p.s.i. | 64 | 102 | 115 | 121 | 119 | 120 |
| Hardboard Properties | | | | | | |
| Density, lbs./ft.$^3$ | 58.5 (55.1)[b] | 54.6 | 56.7 | 53.7 | 56.4 | 58.3 |
| M.O.R.,[e] p.s.i. | 4528 (4089)[b] | 4570 | 5513 | 5256 | 5731 | 6053 |
| Perp. Tensile p.s.i. | 127 (186)[b] | 211 | 352 | 350 | 384 | 437 |
| Water Absorption, % | 17.1 (21.5)[b] | 18.0 | 16.0 | 16.6 | 14.5 | 14.8 |
| Thickness Swelling, % | 22.2 (25.8)[b] | 22.3 | 18.8 | 19.1 | 15.9 | 16.0 |

[a]Regular binder and ferric sulfate added at stock chest; baked at 300° F. for 2 hours.
[b]Ibid, but not oven baked.
[c]Corrected to 15 lbs./ft.$^3$.
[d]Corrected to 15 lbs./ft.$^3$.
[e]Corrected to 56.5 lbs./ft.$^3$.

EXAMPLE 5

In this case, wood chips that had been treated with raw linseed oil in amounts of either 2% or 3% by weight of the chips were blended in 50/50 and 35/65 weight percent proportions with untreated wood chips before passing the chips to the Bauer refiner for defibering. The resultant pulp was processed into ⅛th inch hardboard without any processing difficulties; and the pressed boards were then humidified and tested for physical properties as set forth in Table 5. Again the most significant increases were for tensile strength perpendicular to the surface of the board samples.

TABLE 5

| Additives: | Control[a] | All 2% Oil | All 3% Oil | 50%[2] 3% Oil | 35%[3] 3% Oil | 50% 2% Oil | 35% 2% Oil |
|---|---|---|---|---|---|---|---|
| Hardboard Properties | | | | | | | |
| Density, lbs./ft.$^3$ | 64.3 | 64.7 | 66.9 | 61.2 | 65.9 | 68.6 | 64.9 |
| Transverse break, lbs. | 38.6 | 42.5 | 42.8 | 42.9 | 42.5 | 42.6 | 42.5 |
| M.O.R.,[b] p.s.i. | 5930 | 6739 | 7379 | 6875 | 6540 | 6624 | 6685 |
| Perp. Tensile,[b] p.s.i. | 233 | 459 | 648 | 395 | 284 | 296 | 336 |
| Water Absorption, % | 25.8 | 19.5 | 20 | 18.9 | 20 | 19.1 | 21.6 |
| Thickness Swelling, % | 29 | 26.1 | 21.2 | 24.6 | 25.9 | 24.5 | 27.8 |

[a]Conventionally processed with 1% binder and 0.5% ferric sulfate added to stock chest, and without baking following pressing.
[b]Corrected to 65 lbs./ft.$^3$ density.

EXAMPLE 6

In another trail evaluation, nominal ⅛th inch hardboard was made in a hardboard plant according to standard plant procedures. Then the run was varied to bypass the bake oven, eliminate regular binder addition to the stock chest, and to spray variable amounts of raw linseed oil over chips traveling to the cooker. In all other aspects, normal plant procedures including digester steam procedure, wood chip cooking time and pressure; refining and hardboard pressing were followed. No difficulties were encountered in the processing line; physical properties of the pressed boards are set forth in Table 6; and preliminary evaluations as to paintability, paint holdout, acceptance of various coatings, and cutting and routeability were satisfactory.

While the foregoing examples illustrate the present invention in terms of making high density hardboard (panel manufactured primarily from inter-felted lignocellulosic fibers consolidated under heat and pressure in a hot-press to a density of greater than 50 lbs. per cubic foot and specific gravity of 0.80), it is readily apparent to those skilled in the art that the present invention is readily applicable to other weights and densities of wood base fiber panel materials such as medium-density hardboard (having a density between 31–50 lbs. per cubic foot, specific gravity between 0.50 and 0.80) and structural insulating board (having a density of less than 31 lbs. per cubic foot, specific gravity 0.50) and the like. While the present invention has been illustrated in terms of wet felting the board mat, it is readily apparent that the process of the present invention is readily applicable to dry fiber felting; and that various changes in equipment and processing conditions may be made without effecting the spirit and scope of the present invention as claimed.

TABLE 6

| Treatment: | Control 1% Regular Binder | 1% Oil Treated Chips | 2% Oil Treated Chips | 3% Oil Treated Chips |
|---|---|---|---|---|
| Hardboard Properties | | | | |

TABLE 6-continued

| Treatment: | Control 1% Regular Binder | 1% Oil Treated Chips | 2% Oil Treated Chips | 3% Oil Treated Chips |
|---|---|---|---|---|
| Weight per MSF-lbs. | 727 | 714 | 742 | 710 |
| Caliper-inches | 0.128 | 0.128 | 0.121 | 0.124 |
| Density-lbs/ft.$^3$ | 69.4 | 69.1 | 73.0 | 67.7 |
| Transverse Break-lbs. | 43.8 | 46.4 | 49.5 | 48.0 |
| M.O.R.-psi | 8606 | 9091 | 10362 | 8975 |
| M.O.R.-corrected | 8266 | 8769 | 8967 | 9055 |
| Perp. Tens.-psi | 360 | 399 | 615 | 508 |
| Perp. Tens.-corrected | 384 | 383 | 539 | 534 |
| Water Absorption-% | 32.6 | 24.6 | 13.8 | 18.8 |
| Caliper Increase | 20.3 | 19.4 | 12.4 | 15.3 |

The invention having thus been described, what is claimed and desired to be secured by Letters Patent is:

1. An improved process for manufacturing wood fiber board characterized by eliminating the conventional baking step that follows pressing of the mat to board and by imparting additional strengths and water resistance to the formed board which comprises:

(1) reducing a supply of wood to chips;

(2) blending a small amount of drying oil with said chips, said drying oil ranging from about 0.5% to about 10% by dry weight of the wood chips;

(3) steaming the treated wood chips in a closed vessel for a period of time from about 1 to 10 minutes and at a pressure between about 50 and 300 lbs. per square inch, whereby the drying oil is sorbed into the wood chips;

(4) refining the wood chips whereby the treated chips are formed into fibers;

(5) forming the fibers into an aqueous slurry pulp;

(6) mechanically dewatering the pulp to obtain a wet mat;

(7) drying the wet mat by thermal evaporization;

(8) and pressing the dried mat between heated forming surfaces to form a hardboard.

2. The process of claim 1 wherein the drying oil is added in an amount ranging from about 1% to about 5% by dry weight of the wood chips.

3. The process according to claim 1 in which a small amount of an oxidative catalyzing agent for the drying oil is added to the aqueous wood fiber slurry pulp.

4. The process of claim 1 wherein said drying oil is linseed oil.

5. The process of claim 1 wherein said drying oil is linseed oil, said linseed oil is added in an amount between about 1% and 5% by dry weight of the wood chips; and further wherein between about 0.1% and 2% by dry fiber weight of an oxidation accelerator is added to the aqueous wood fiber slurry pulp.

6. The process of claim 5 in which said accelerator is ferric sulfate.

7. An improved process for manufacturing wood fiber hardboard characterized in having a modulus of rupture of at least about 7,000 lbs. per square inch, and a tensile strength perpendicular to surface of at least about 150 lbs. per square inch, and further characterized by eliminating the conventional baking step after pressing of the mat to hardboard, which comprises:

(1) reducing a supply of wood to chips;

(2) blending a small amount of drying oil with said chips, said drying oil ranging in amount from about 0.5% to about 10% by dry weight of the wood chip feed;

(3) steaming the treated wood chips in a closed vessel for a period of time from about 1 minute to about 10 minutes and at a pressure between about 50 and about 300 lbs. per square inch, whereby the drying oil is sorbed into the wood chips while the wood chips are being softened by such cooking;

(4) refining the treated wood chips whereby the treated chips are fiberized;

(5) forming the fibers into an aqueous slurry pulp;

(6) adding to the aqueous fiber slurry a small amount of an oxidation accelerative agent for the drying oil;

(7) mechanically dewatering the pulp to obtain a water mat;

(8) drying the wet mat by thermal evaporization;

(9) pressing the dry mat between heated forming surfaces to form a hardboard; and

(10) humidifying the hardboard product to absorb from about 2 to 9% moisture by weight of the board and obtain a tempered hardboard product.

8. The process of claim 7 wherein the drying oil is added in an amount ranging from about 1% to about 5% by dry weight of the wood chips.

9. The process of claim 7 wherein the oxidation accelerating agent for the drying oil is ferric sulfate, and said ferric sulfate is added to the slurry at a rate of about 0.1–2% based on the dry fiber weight.

* * * * *